US006595126B2

(12) United States Patent
Nagao et al.

(10) Patent No.: US 6,595,126 B2
(45) Date of Patent: Jul. 22, 2003

(54) PRINTING CONTROL DEVICE FOR PRINTING MACHINE HAVING PLURAL PRINTING DRUMS

(75) Inventors: Noriaki Nagao, Amimachi (JP); Mitsuaki Ishitoya, Amimachi (JP); Jianmin Xiong, Amimachi (JP); Michael Mehigan, Amimachi (JP); Nami Higashio, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 22 days.

(21) Appl. No.: 09/941,695

(22) Filed: Aug. 30, 2001

(65) Prior Publication Data

US 2002/0029702 A1 Mar. 14, 2002

(30) Foreign Application Priority Data

Sep. 12, 2000 (JP) ..... 2000-277076

(51) Int. Cl.[7] ..... B41L 13/16; B41L 13/04

(52) U.S. Cl. ..... 101/115; 101/116; 101/484; 345/771

(58) Field of Search ..... 101/114, 115, 101/116, 119, 120, 129, 484, 171, 211; 345/771, 772, 773, 777, 810, 841, 843, 838, 965; 400/61

(56) References Cited

U.S. PATENT DOCUMENTS 6,205,918 B1 3/2001 Takahashi et al.
2002/0029703 A1 * 3/2002 Kubota et al. ..... 101/115

FOREIGN PATENT DOCUMENTS

WO WO 97/21548 6/1997

* cited by examiner

*Primary Examiner*—Leslie J. Evanisko
(74) *Attorney, Agent, or Firm*—Nath & Associates PLLC; Marvin C. Berkowitz

(57) ABSTRACT

A user PC 120 for controlling a stencil printing machine 1, having a plurality of exchangeable printing drums, wherein respective printing drums are mounted with respective perforated stencil sheets which are formed by a stencil-making processing section 104 on the basis of image data, and a print sheet is held in press contact with the plural printing drums to perform a stencil printing process with first and second stencil-printing processing sections 105, 106 is disclosed as having a registering function to register printing ink colors to be used for printing with the respective printing drums by enabling reading-in of a printer driver and to store useable ink color information, a function to produce display data to display contents of the ink-color designating information produced by the designating section for the respective printing drums.

12 Claims, 10 Drawing Sheets

PRINTING CONTROL DEVICE FOR PRINTING MACHINE HAVING PLURAL PRINTING DRUMS

BACKGROUND OF THE INVENTION

1. Field of the Invention

The present invention relates to a printing control device, a record medium storing thereon a computer-readable program and a printing system for controlling a stencil printing machine, having a plurality of exchangeable printing drums, wherein plural stencil sheets formed on the basis of image data are mounted on the respective printing drums with which a print sheet is held in press contact to achieve stencil printing.

2. Description of the Related Art

Conventionally, it has heretofore been proposed to employ a stencil printing machine which includes a plurality of printing drums which are allocated with different ink colors to enable a single color printing or a multi-color printing.

In such a stencil printing machine, for example, first and second printing drums and a press drum are located for free rotational movement and the first and second printing drums are arranged so as to assume respective positions angled at 90 degrees with respect to a central angle of the press drum in the vicinities of an outer circumferential periphery of the press drum.

With such a structure, when implementing a stencil printing operation, leading edges of perforated stencil sheets formed on the basis of image (print) data for first and second ink colors are initially clamped with stencil clamping segments of the first and second printing drums, respectively, with the perforated stencil sheet traveling between the first printing drum and the press drum along the outer circumferential periphery of the press drum for thereby allowing printing ink with the first color to be transferred to the print sheet through an perforated area of the stencil sheet.

Upon transfer of printing ink with the first color, the print sheet is then transferred between the second printing drum and the press drum to pass (execute printing operation) between the second printing drum and the press drum for allowing printing ink with the second color to be transferred to the print sheet in the same principle as discussed above. Subsequently, a sheet discharge section discharges the print sheet, on which desired printing image data is reproduced, to a given paper receiving position to complete the multi-color printing operation.

SUMMARY OF THE INVENTION

By the way, although the aforementioned stencil printing machine is known, extensive research and development work has not been conducted for a printer driver which enables control for the stencil printing machine. That is, with such a prior art printer driver, there have been many instances wherein a difficulty is encountered in designating ink colors for the printing drums.

In the printer driver for controlling the prior art stencil printing machine, there are some instances wherein in case of using four kinds of ink, in a four-color printing operation, involving for example C (cyan), M (magenta), Y (yellow) and K (black), a printing command is issued by allocating yellow, cyan, magenta and black to first, second, third and fourth printing drums, respectively, and wherein in case of a two-color printing mode, a printing command is issued by allocating red and black colors to first and second printing drums, respectively. In both of these cases, the stencil printing machine does not encounter confusion even in the absence of ink color information, allocated for respective printing drums, in data transmitted from the printer driver.

However, in the stencil printing machines of the type using cartridge type printing drums which are exchangeable for respective ink colors, there are some possibilities wherein the ink color of the printing drum is altered every time the printing operation is performed. When it is possible to alter the ink color for the printing drum, there are a great number of combinations of ink colors to be required in dependence on the number of the printing drums. In the prior art stencil printing machine for two-color printing, for example, when the user has five exchangeable printing drums, it is considered that there are twenty kinds of combinations.

In case of implementing the ink color management for such a great number of ink-color combinations relying on user's memory, the printing operation requires a troublesome work, causing undesirable error in combination of the print colors and requiring much time in operations. In such a prior art stencil printing machine, as the number of internal printing drums and the number of the printing drums held for different ink colors increases, the problems become more and more serious.

It is therefore an object of the present invention to provide a printing control device, a record medium storing thereon a computer-readable program and a printing system for controlling a stencil printing machine, employing plural exchangeable printing drums, which is able to provide an ease of ink-color management and leads to a significant improvement in the total handling characteristics, such as maneuverability, readiness and maintainability.

According to a first aspect of the present invention, there is provided a printing control device for controlling a stencil printing machine, having a plurality of exchangeable printing drums, wherein respective printing drums are mounted with respective perforated stencil sheets which are formed on the basis of image data, and a print sheet is held in press contact with the plural printing drums to perform a stencil printing process, which comprises a registering section for registering printing ink colors to be used for the printing process using the respective printing drums and storing useable ink color information, a designating section for producing ink-color designating information to designate a correlated relationship between the useable ink color information indicative of the ink colors registered by the registering section when executing the printing process using the respective printing drums, and a display data producing section for producing display data to display contents of the ink-color designating information produced by the designating section for the respective printing drums.

According to a second aspect of the present invention, there is provided a computer-readable record medium having stored thereon a program for controlling a stencil printing machine, having a plurality of exchangeable printing drums, wherein respective printing drums are mounted with respective perforated stencil sheets which are formed on the basis of image data, and a print sheet is held in press contact with the plural printing drums to perform a stencil printing process, which comprises a registering section for registering printing ink colors to be used for the printing process using the respective printing drums and storing useable ink color information, a designating section for producing ink-color designating information to designate a correlated relationship between the useable ink color information indicative of the ink colors registered by the registering section when executing the printing process using the respective printing drums, and a display data producing section for producing display data to display contents of the ink-color designating information produced by the designating section for the respective printing drums.

According to a third aspect of the present invention, there is provided a printing system which comprises a stencil printing machine, including a plurality of exchangeable printing drums, wherein respective printing drums are mounted with respective perforated stencil sheets which are formed on the basis of image data, and a print sheet is held in press contact with the plural printing drums to perform a stencil printing process, and a printing control device including a transmitting section connected to the stencil printing machine for transmitting print data thereto via a communication network, a registering section for registering printing ink colors to be used for printing with the respective printing drums and storing useable ink color information, a designating section for producing ink-color designating information to designate a correlated relationship between the useable ink color information indicative of the ink colors registered by the registering section when executing the printing process using the respective printing drums, and a display data producing section for producing display data to display contents of the ink-color designating information produced by the designating section for the respective printing drums.

An important feature of the present invention concerns the readiness of the ink-color management which is executed in the stencil printing machine, having a plurality of exchangeable printing drums, wherein the printing ink colors, to be used for printing with the respective printing drums, are registered and the useable ink color information is registered, and wherein ink-color designating information, which designates correlated relationship between the ink-color information, indicative of the printing ink color to be used for printing with the respective printing drums, and the respective printing drums, is produced to be provided to the user.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

To describe the present invention more in detail, a preferred embodiment of the present invention will be described below in detail with reference to the drawings.

Figure 1:
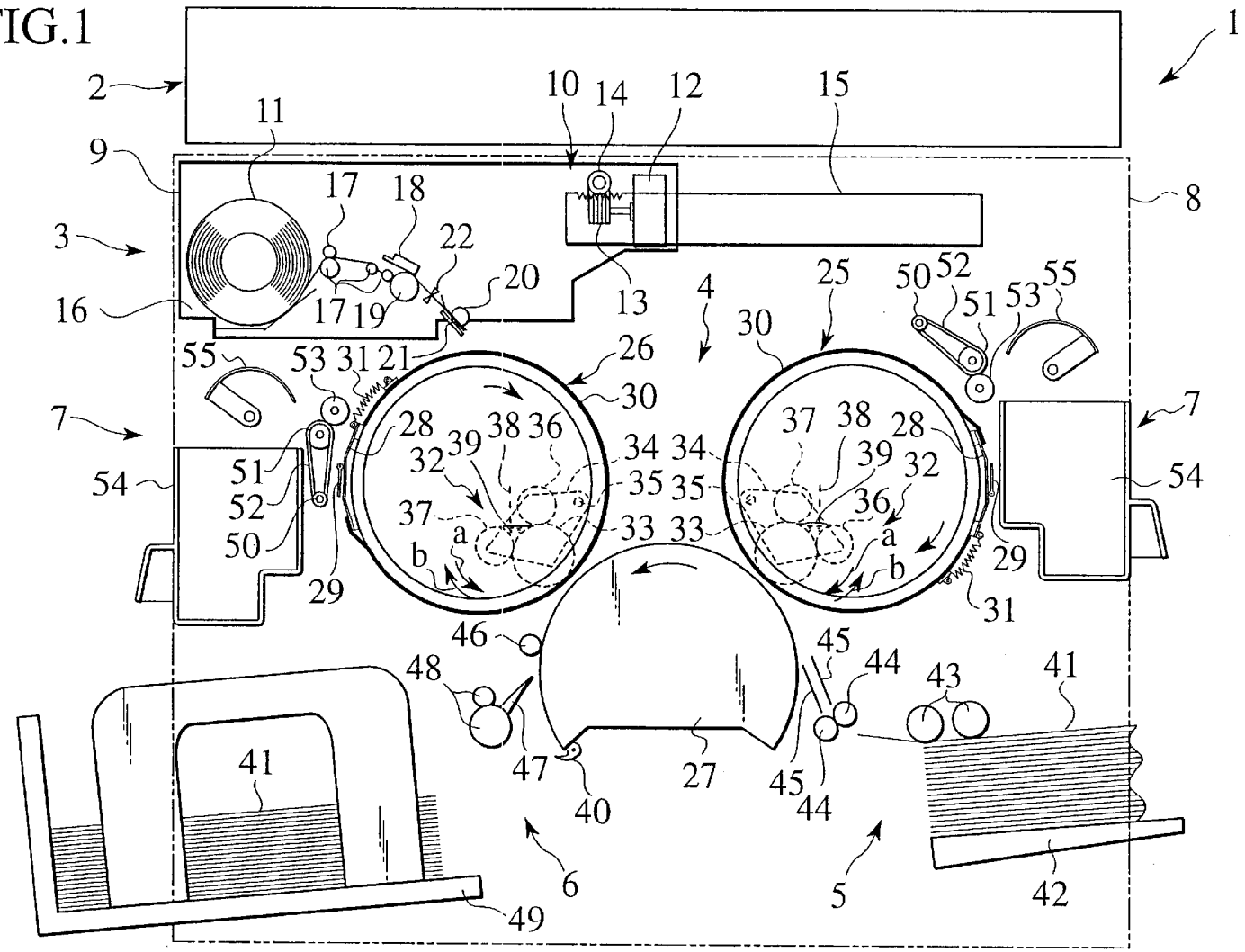
FIG. 1 is a schematic structural view of a stencil printing machine of a preferred embodiment according to the present invention.

The present invention is applied to a printer driver for controlling a stencil printing machine 1 which is, for example, constructed as shown in FIG. 1. The stencil printing machine 1 is described below with respect to a structure including, for example, two printing drum mounting sections and printing drums of cartridge type.

As shown in FIG. 1, the stencil printing machine 1 is mainly constructed of an original reader section 2, a stencil making section 3, a printing section 4, a paper feed section 5, a sheet discharge section 6, and stencil disposal sections 7 mounted at two locations.

The original reader section 2 is located above a body frame 8 and reads an image pattern, as input image data of an original to produce a train of electric signals. The train of electric signals, which represents image data of the original, are processed to produce output image data signals to be reproduced as respective color image data signals indicative of printing ink in first and second colors for first and second printing drums. Also, in this event, the output image data signals can be further processed on the basis of given commands (i.e., commands for scale up or scale down, etc.).

The stencil making section 3 includes a stencil making unit 9 mounted in the body frame 8 for free horizontal movement. The stencil making-unit 9 is moveable with a stencil making unit transfer device 10 between a first stencil sheet feeder position to allow a first perforated stencil sheet 11 to a first printing drum 25 and a second stencil sheet feeder position to allow the stencil sheet 11 to a second printing drum 26. The stencil making-unit transfer device 10 is constructed having a stencil making-unit transfer motor 12, a worm gear 13 fixed to a rotary shaft of the stencil sheet making-unit transfer motor 12, a worm wheel (not shown) meshing with the worm gear 13, a pinion gear 14 connected to the worm wheel at an central axis thereof, and a rack 15 fixedly mounted to the body frame 8.

The stencil making unit 9 includes a stencil sheet roll container 16 which receives an elongated stencil sheet 11 formed in a rolled shape, a plurality of feed rollers 17 adapted to guide a leading edge of the stencil sheet 11 received in the stencil sheet roll container 16 toward a downstream side, a thermal printing head 18 located at a downstream side of the feed rollers 17, a platen roller 19 which is located in an opposed position of the thermal printing head 18 and which rotates with drive force exerted by a pulse motor (not shown), a stencil sheet feed roller 20 located at a downstream side relative to the platen roller 19 and the thermal printing head 18 and adapted to be driven with the drive force of the pulse motor, a guide plate 21 to which the stencil sheet feed roller 20 is held in contact in a pressurized relationship, and a stencil sheet cutter 22 located between a first area of the stencil sheet feed roller 20 and the guide plate 21 and a second area of the platen roller 19 and the thermal printing head 18.

The printing section 4 includes the first printing drum 25, the second printing drum 26, and a press drum 27, which serves as a rotary printing press member to impart printing pressure to the first and second printing drums 25 and 26, with both the first and second printing drums 25 and 26 being located above the press drum 27 at right and left positions thereof which are obliquely oriented relative to the center of the press drum 27. In particular, the first and second printing drums 25 and 26 are placed in close proximity to an outer circumferential periphery of the press drum 27 at positions angled at 90 degrees relative to a central axis of the press drum 27. The first and second printing drums 25 and 26 and the press drum 27 are rotatably mounted in the body frame 8, and are rotated with a printing drum rotating mechanism (not shown) at the same peripheral speeds in the vicinities of a first contact zone between the first printing drum 25 and the press drum 27 and a second contact zone between the second printing drum 26 and the press drum 27. The printing drum rotating mechanism is driven with a main motor (not shown) which serves as a drive source. The first and second printing drums 25 and 26 have respective annular frame pairs (bearing no reference numerals) which are interconnected with stencil clamping bases 28, forming respective parts of outer circumferential peripheries of the first and second printing drums 25 and 26, respectively. The stencil clamping bases 28 have respective stencil clamping segments 29, by which leading edges of the stencil sheets 11 are clamped, respectively. Also, a leading edge of a screen 30 is fixed to each of the stencil clamping bases 28, with each screen 30 being wound on each of outer circumferential peripheries of the first and second printing drums 25 and 26.

A trailing edge portion of each screen 30 is stretched over each of the stencil clamping bases 28 by a spring 31, with each screen 30 being arranged to be expandable outward against the force of the spring 31. Each screen 30 is constructed of, for example, a mesh-shaped porous structure which, when it is pressed with an inner press roller 33, which will be discussed below, permits printing ink 38 to permeate from inward to outward. Thus, each screen 30 forms each outer circumferential periphery, which is supplied with printing ink 38, of each of the first and second printing drums 25 and 26.

Inside each of the screens 30 of the first and printing drums 25 and 26, an inner press mechanism 32 is accommodated. Each inner press mechanism 32 includes the inner press roller 33 which has a first function to exert a printing pressure to the screen 30 and a second function to supply the printing ink 38 to the screen 30.

Each of the inner press rollers 33 is rotatably supported by a pair of roller support members 34 located at both sides of each press roller and is rotated with a drive means, which is not shown, in synchronism with rotations of the first and second printing drums 25 and 26. The roller support members 34 are supported on a pivot shaft 35 for rotational movement thereabout such that, with rotation of the roller support members 34 in a direction as shown by an arrow a in FIG. 1, the roller support members 34 are moveable between an operative, press engagement position to cause the inner press roller 33 to press an inner periphery of the screen 30, and an inoperative, wait position when the roller support members 34 are rotated in a direction as shown by an arrow b. Each of the inner press rollers 33 assumes either the press engagement position during printing operation or the wait position during non-printing operation.

Further, each of the roller support members 34 carries first and second doctor rollers 36 and 37. The first and second doctor rollers 36 and 37 include cylindrical columns, respectively, and both are located in the vicinity of the inner press roller 33. Printing ink 38 is supplied from an ink supply unit (not shown) to a specified area in the vicinities of an outer circumferential space of the inner press roller 33 and an upper space surrounded between the first and second doctor rollers 36 and 37, with an ink pool 39 being formed in the specified area. The first printing drum 25 is supplied with printing ink 38 with a first color, and the second printing drum 26 is supplied with printing ink 38 with a second color.

A gap (an opposing distance) between the first doctor roller 36 and the inner press roller 33 is preset to a value sufficient for printing ink to be formed on the inner press roller 33 with a given thickness of an ink film, and a gap between the second doctor roller 37 and the inner press roller 33 is preset to have a value suitable for printing ink to be prevented from being leaked. That is, as the inner press roller 33 rotates, printing ink with the given film thickness is continuously adhered to an outer circumferential surface of the inner press roller 33 owing to the gap between the first doctor roller 36 and the press roller 33, allowing the inner press roller 33 to supply printing ink onto the screen 30.

In addition, a print sheet clamp segment 40 is located at a given position of an outer circumferential periphery of the press drum 27, which serves as the rotary printing press member to impart a printing pressure to the printing drum, thereby clamping an edge of the print sheet 41 which is a print medium.

The paper feed section 5 is constructed as having a paper feed tray 42 on which print sheets 41, each serving as a print medium, are stacked, primary paper feed rollers 43, which is kept in press engagement with an uppermost print sheet 41 stacked on the paper feed tray 42, a secondary paper feed roller pair 44 located downstream of the primary paper feed rollers 43 and a guide plate pair 45 serving as a transfer guide for the print sheet between the secondary paper feed roller pair 44 and the press drum 27. Rotation of the paper feed rollers 43 causes only the uppermost print sheet 41 on the stack thereof to be transferred to the secondary paper feed roller pair 44, with the transferred print sheet 41 being fed to the printing section 4 in synchronism with the press drum 27 due to rotation of the paper feed roller pair 44.

The sheet discharge section 6 includes an upper limit guide segment 46 for guiding the leading edge of the print sheet 41 after it's printing step has been completed, a sheet separator claw 47 for separating the print sheet 41 from the press drum 27, a sheet discharge roller pair 48, which transfers the print sheet 41 guided by the upper limit guide 46 or the print sheet 41 separated with the sheet separator claw 47, and a paper receiving tray 49 which stacks the print sheets 41, discharged from the sheet discharge roller pair 48, in a stacked state.

The stencil disposal sections 7 are located in the frame body 8 in the vicinities of the first and second printing drums 25 and 26, respectively. Each of the stencil disposal sections 7 includes a pair of stencil discharge rollers 50 and 51, which are located in the vicinity of each of the first and second printing drums 25 and 26 in a slightly spaced relationship relative to each outer periphery, a stencil guide belt 52 which guides a leading edge of the stencil sheet 11 released from the stencil clamp segment 29, a stencil discharge roller 53 which transfers the stencil sheet 11, guided with the stencil guide belt 52, while separating it from each of the first printing drum 25 and the second printing drum 26 in conjunction with the stencil discharge roller 51, a stencil disposal box 54 for receiving the stencil sheet 11 transferred from the stencil discharge rollers 51 and 53, and a stencil compressing plate 55 for compressing the stencil sheets 11 toward a rearmost side of the stencil disposal box 54.

Figure 2:
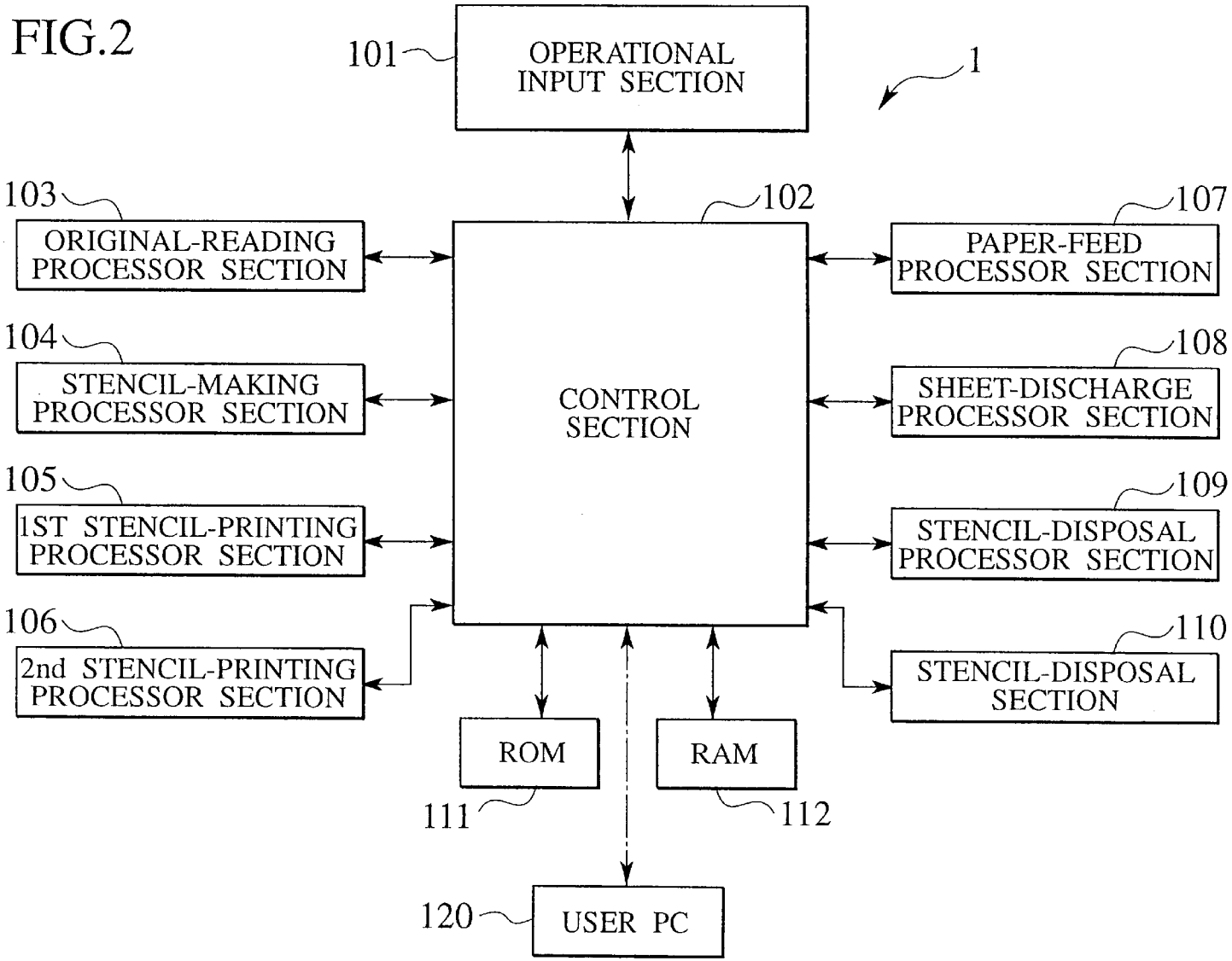
FIG. 2 is a block diagram of a control system for the stencil printing machine of the first preferred embodiment according to the present invention.

Now, a control system for controlling the operation of the stencil printing machine 1 is described below in detail with reference to FIG. 2. As shown in FIG. 2, the body frame of the stencil printing machine 1 of the preferred embodiment of the present invention is provided with an operation input section 101. The operation input section 101 includes a stencil-making/printing start-up key, ten keys for inputting various input data such as the number of print sheets, a single-color printing key, and a display panel section for providing a display of various data (all of which are not shown).

The operation input section 101 produces various operation input information signals in response to user's various set-up operations and outputs these information signals to a control section 102.

Input data is outputted from the operation input section 101 to the control section 102, which responds to the input data and executes general control over an original-reading processor section 103, a stencil-making processor section (stencil making section) 104, first and second stencil-printing processor sections (printing sections)105 and 106, a paper-feed processor section 107, a sheet discharge processor section 108, and stencil-disposal processor sections 109 and 110, which are located at two different positions.

Also, the control section 102 executes control for writing-in or reading-out from a ROM 111, in which various control programs are stored, and a RAM 112.

Further, the control section 102 is interconnected with a personal computer 120 (which is hereinafter called as a user PC 120) via a communication network such that it is enabled to read in image data and printer control commands from the user PC 120.

The control section 102 responds to printer control commands, which are produced by the printer driver installed in the user PC 120, for executing operational control, such as input of image data, start-up and stop control of stencil making operation, and start-up and stop control of printing operation.

The user PC 120 is constructed as including a display monitor for providing a display of various contents, an input-output interface for enabling transfer and receiving of various information, a memory unit which stores image data and printer control programs (i.e., the printer driver) to control the operation of the stencil printing machine 1, a CPU (Central Processing Unit) which executes the start-up of the printer control programs in response to the user's operation inputs, transmission of data to the stencil printing machine 1, and transmission of the printer control commands.

The CPU functions to read out the printer driver from the memory unit for providing a display screen over the display monitor to facilitate user's operation for executing an ink-color registering process, an ink-color set up process, a color-number set up process, a separate-stencil making set up process and a sampling displaying process, etc., thereby enabling various operations demanded by the user's operation.

Figure 3:
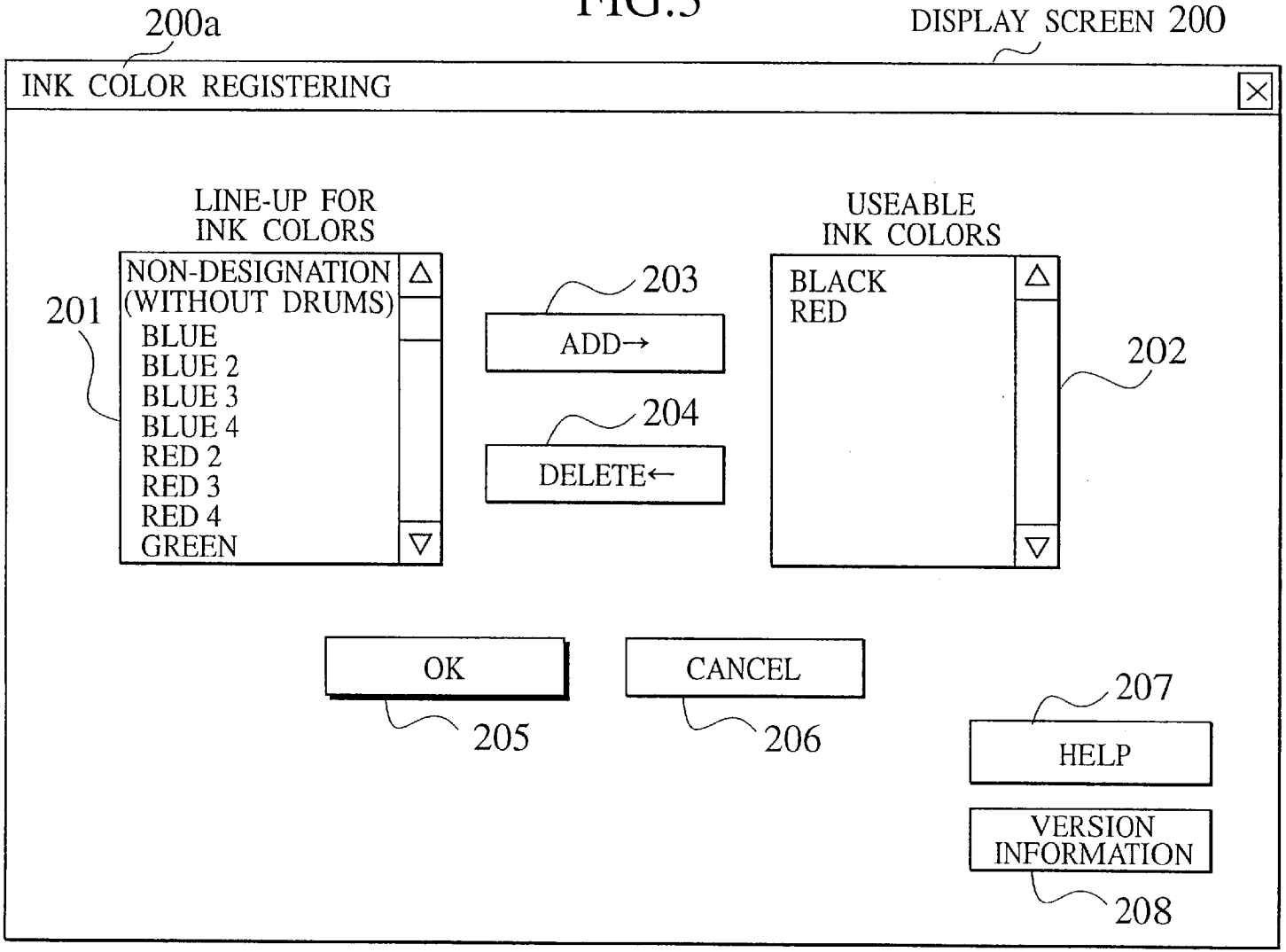
FIG. 3 is a schematic view for illustrating display contents appearing on a display monitor when executing ink color registering process with a user PC which is applied with a principal concept of the present invention.

During executing the ink-color registering process, the CPU allows the display screen 200 to appear as viewed in FIG. 3. The display screen 200 has at the top of the window a tool bar 200*a* marked "REGISTERING INK COLOR". As seen in FIG. 3, the CPU enables the display of a line-up display section 201 for indicating a package including a search menus involving various ink colors to be set up for the first and second printing drums 25 and 26, respectively, and a package of a useable ink color display section 202 including a search menus involving the useable ink colors to be used in relation with the first and second printing drums 25 and 26, respectively. Here, the ink colors to be selected in the useable ink color display section 201 correspond to the printing drums which the user holds.

During executing the ink-color registering process, further, the CPU enables an "ADD" button display 203 and a "DELETE" button display 204 to appear over the display screen 200. Upon user's selection of the "ADD" button display 203, operation is executed to add the ink color, which has been selected from the number of ink colors displayed in the search menus of the line-up display section 201, to the useable ink color display section 202. With such an "ADD" operation, the CPU completes the process for registering the useable ink color. When selecting the "DELETE" button display 204 with the user's operation, the CPU executes a "DELETE" function to delete the registered ink color, to be unselected, which has been displayed in the search menus of the useable ink color display section 202, from the useable ink color display section 202. Thus, the CPU performs a cancellation process for disabling the registration of the ink color which has been preliminarily registered as the useable ink color.

During execution of the ink-color registering process, further still, the CPU enables an "OK" button display 205, a "CANCEL" button display 206, a "HELP" button display 207 and a "VERSION INFORMATION" button display 208 to appear over the display screen 200. Upon selection of the "OK" button display 205, the CPU executes the setting of the aforementioned registering processes and registration-canceling processes. Selection of the "CANCEL" button display 206 enables the CPU to cancel the aforementioned registering processes and the registration-canceling processes. Upon selection of the "HELP" button display 207, the CPU enables a "HELP" screen to be displayed. Likewise, upon selection of the "VERSION INFORMATION" button display 208, the CPU enables a "VERSION INFORMATION" of the printer driver to be displayed.

Figure 4:
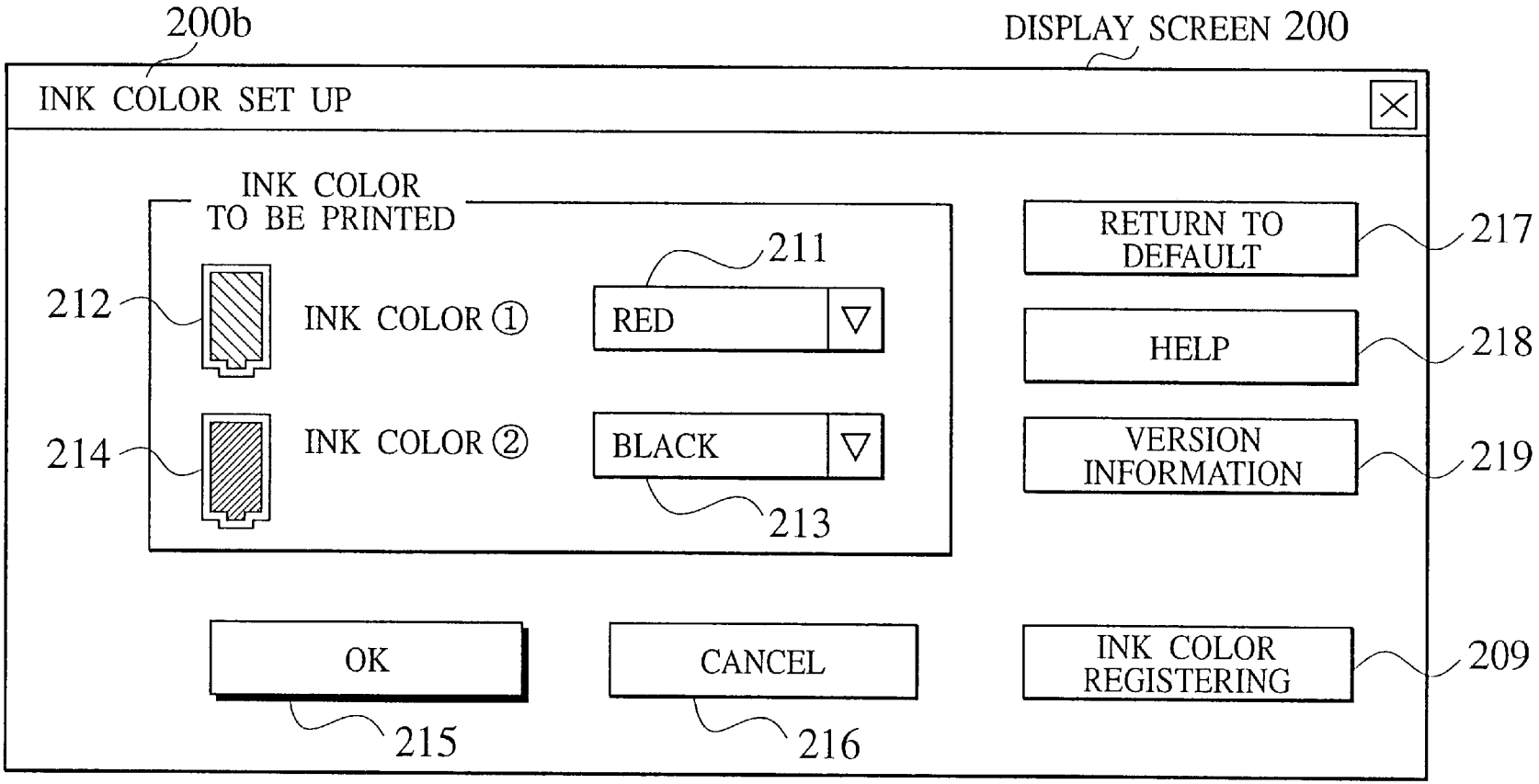
FIG. 4 is a schematic view for illustrating one display content appearing on the display monitor when executing ink color set up process with the user PC which is applied with the principal concept of the present invention.

In the ink-color set up process, the CPU enables the display of the display screen 200 as shown in FIG. 4. In FIG. 4, the display screen 200 has at its top of the window a tool bar 200*b* for a display marked "INK-COLOR SET UP". As seen in FIG. 4, the CPU enables the display of an ink-color set up selection column 211 and an ink-color icon display 212 interactive with the first printing drum 25, and an ink-color set up selection column 213 and an ink-color icon display 214 interactive with the second printing drum 26.

Figure 5:
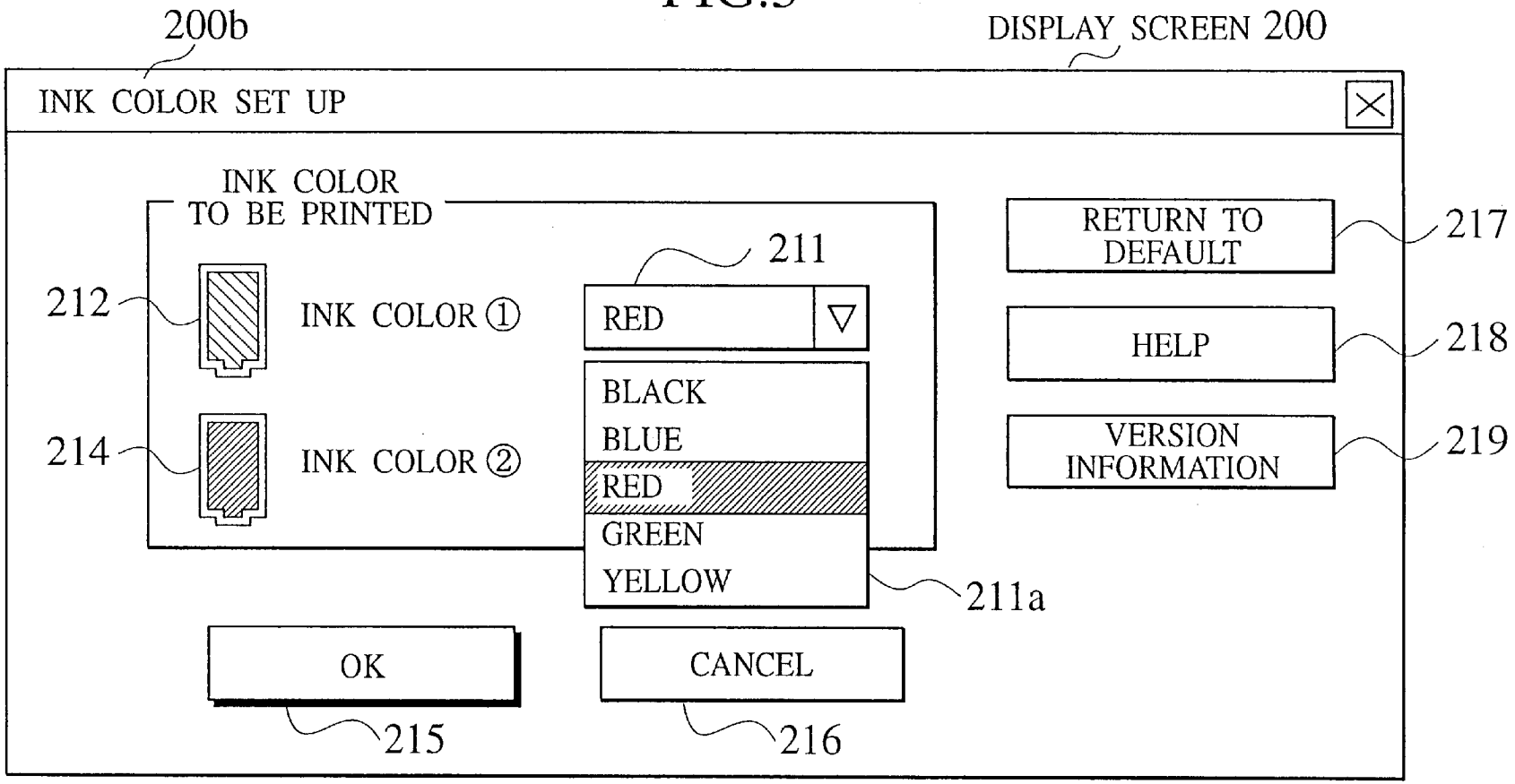
FIG. 5 is a schematic view for illustrating the other display content appearing on the display monitor when executing ink color set up process with a user PC which is applied with a principal concept of the present invention.

When selecting the useable ink color from those which have been registered as the useable ink colors in the aforementioned ink-color registering process, the CPU displays a selection package display 211*a* as viewed in FIG. 5 wherein the display screen has at the top of the window a tool bar 200*b* marked "INK COLOR SET UP", allowing the selected ink color to be recognized as the useable ink color. Likewise, the CPU also displays another selection package display interactive with the second printing drum 26 in the same manner as previously described, thereby enabling the settings of the useable ink color for the second printing drum 26. In a display example shown in FIG. 5, the selection package display 211*a* includes a search menus for "BLACK", "BLUE", "RED", "GREEN" AND "YELLOW", which have been registered, such that when "RED" is selected, the useable ink color to be used for the first printing drum 25 is displayed as "RED".

In the ink-color set up process, further, the CPU allows the "OK" button display 215, the "CANCEL" button display 216, a "DEFAULT" selection display 217, a "HELP" button display 218 and a "VERSION INFORMATION" display 219 to appear over the display screen 200.

Upon selection of the "DEFAULT" selection display 217, the CPU allows the respective useable ink colors, which have been preliminarily set up at an initial installation stage of the printer driver, to be assigned for the first and second printing drums 25 and 26, respectively. Upon selection of the "REGISTER INK COLOR" display 209, the CPU allows the display screen to display the ink-color registering process which has been previously described above with reference to FIG. 3.

Figure 6:
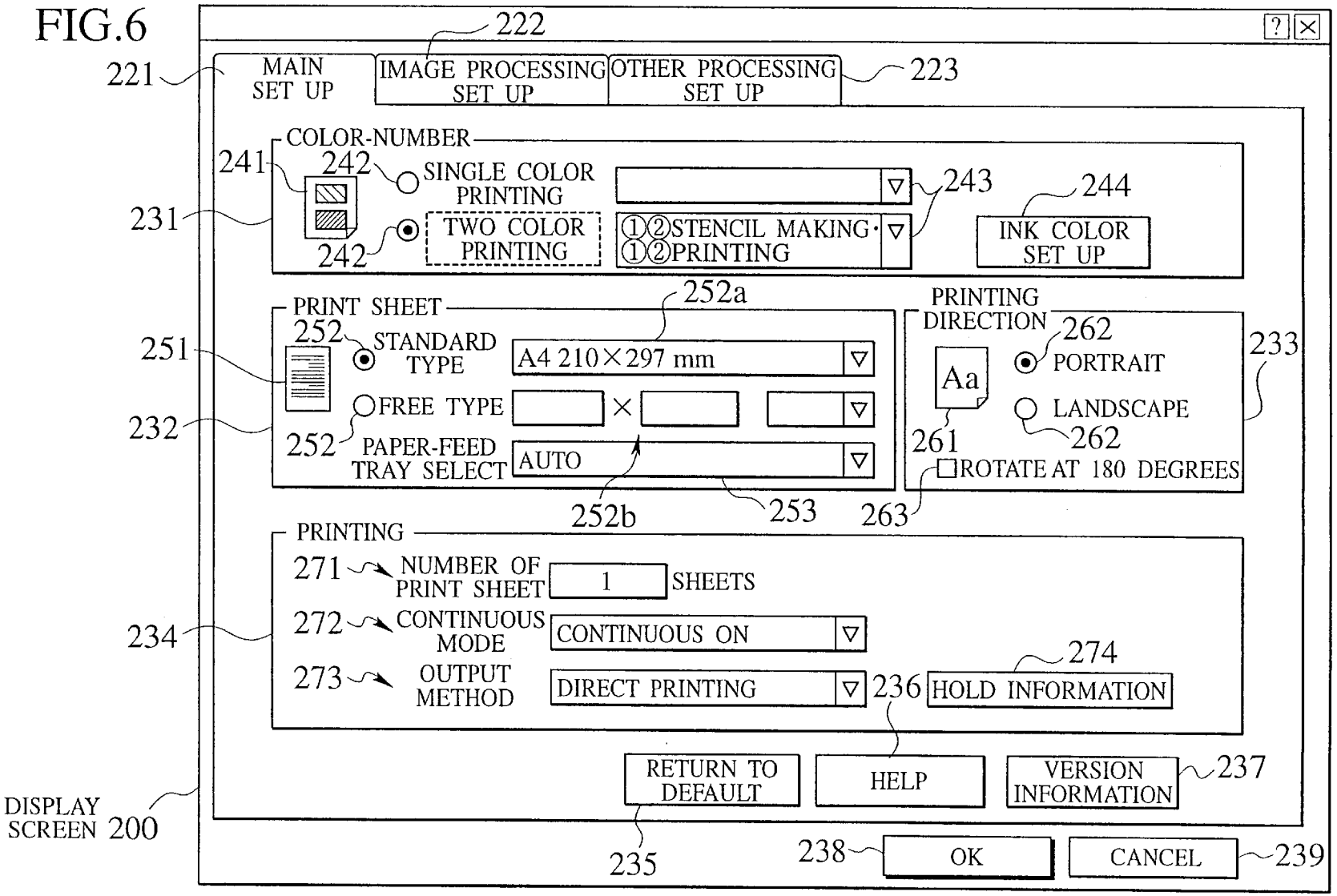
FIG. 6 is a schematic view for illustrating one display content appearing on the display monitor when executing a main set up process with the user PC which is applied with the principal concept of the present invention.

When outputting a printing start-up command with the user's operation, the CPU allows the display screen 200 to appear as shown in FIG. 6. As seen in FIG. 6, the CPU allows a "MAIN SET UP" tab 221, an "IMAGE PROCESSING SETUP" tab 222 and an "OTHER PROCCESSING SET UP" tab 223 to be selectively displayed over the display screen 200, thereby displaying a picture screen for "MAIN SET UP" (see FIGS. 6 and 7) and a picture screen for "IMAGE PROCCESSING SET UP" (see FIGS. 8 to 10).

In accordance with the display screen 200 shown in FIG. 6, the "MAIN SET UP" tab 221 includes a color-number set up display 231, a print-sheet set up display 232, a printing-direction display 233, a printing set up display 234, a "DEFAULT" selection button display 235, a "HELP" button display 236 and a "VERSION INFORMATION" button display 237. Further, the display screen 200 has at the bottom an "OK" button 238 and a "CANCEL" button 239.

The color-number set up display 231 involves a color-number icon display 241, color-number selection boxes 242, 242 indicative of a single color printing mode and a two-color printing mode, respectively, stencil-making/printing set up columns 243, 243 and an ink-color set up button display 244.

In the event that the color-number is selected, the CPU allows the color-number icon display 241 to appear over the display screen 200 in dependence on the number of ink colors which are selected by the user. In the illustrated example, the color-number icon display 241 is shown as representing content when a two-color printing mode is selected.

Upon user's selection of either one of the color-number selection boxes 242, 242, it is possible for the stencil printing machine 1 to be set up in the single-color printing mode to allow the first and second printing drums 25 and 26 to use printing ink with the same ink color or in the two-color printing mode to allow the first and second printing drums 25 and 26 to use printing ink with different colors. In the illustrated example of FIG. 6, the color-number selection box 242 at a lower side is displayed as the two-color printing mode in a selected condition.

Figure 7:
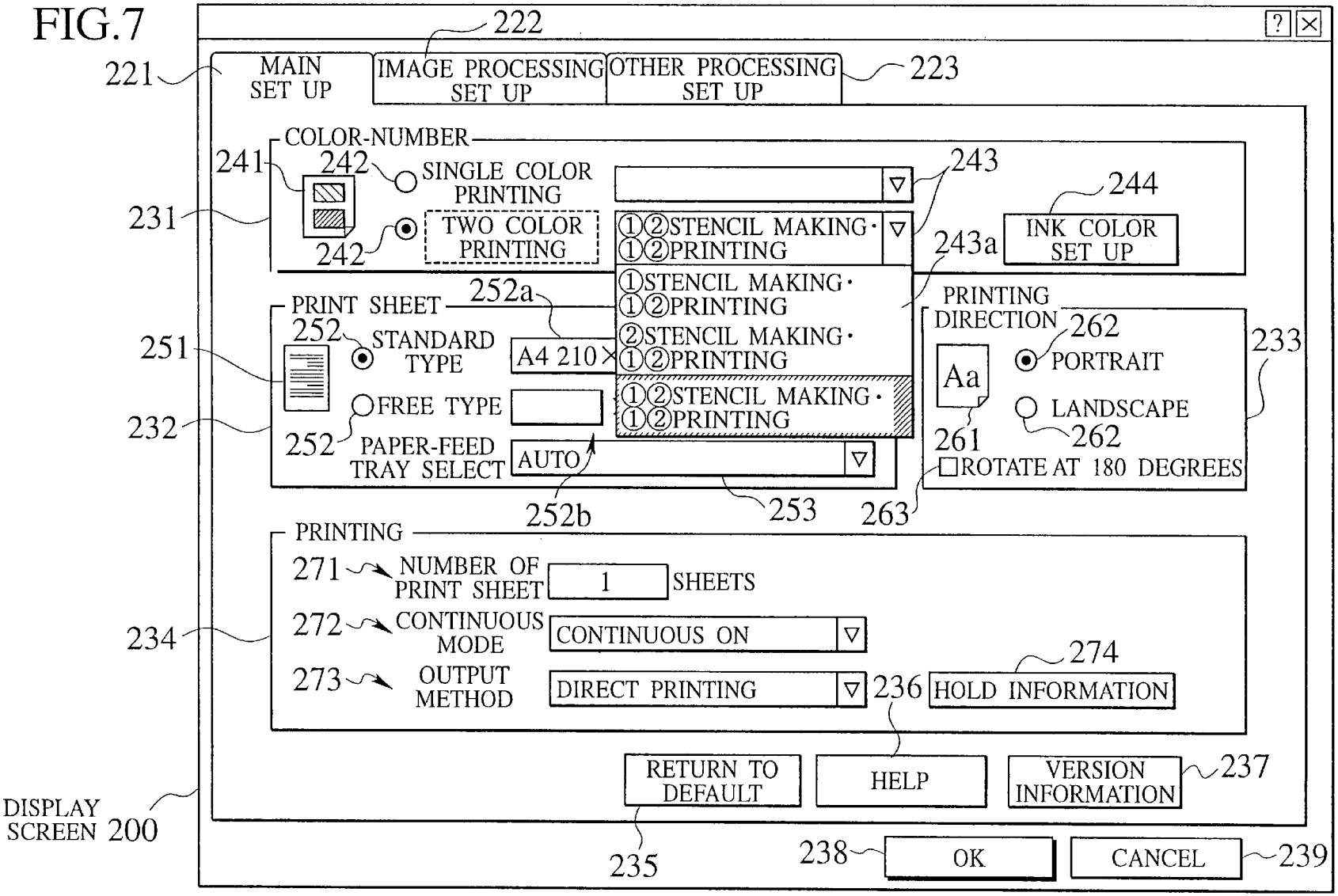
FIG. 7 is a schematic view for illustrating the other display content appearing on the display monitor when executing the main set up process with the user PC which is applied with the principal concept of the present invention.

When the two-color printing mode is selected, the CPU allows a selection package display 243*a* to appear as shown in FIG. 7, enabling the user's selection for either one of an item for executing the stencil making operation and the printing operation for both the first and second printing drums 25 and 26, an item for executing the stencil making operation only for the first printing drum 25 while executing the printing operation with both the first and second printing drums 25 and 26, and an item for executing the stencil making operation only for the second printing drum 26 while executing the printing operation with both the first and second printing drums 25 and 26. In this instance, the CPU allows the printer control commands interactive with contents, which have been selected at the start-up stage of the printing operation, to be transferred to the stencil printing machine 1, thereby enabling control for the stencil making operation and the printing operation with the first and second printing drums 25 and 26.

The print-sheet set up display 232 involves a print-sheet icon display 251, selection boxes 252, 252 indicative of a standard type printing mode and a free type printing mode, a standard-type selection column 252*a*, a free-type designating column 252*b* and a paper-feed tray selection column 253.

Upon selection of either one of the selection boxes 252 with the user's operation, either the standard-type selection column 252*a* or the free-type designating column 252*b* are set up to allow the stencil printing machine 1 to recognize a particular size of the print sheet, while enabling the settings of the paper-feed tray selection column 253 to allow the stencil printing machine 1 to recognize which of the paper feed trays is selected. With such recognition, the CPU is able to produce a printer control signal, designating the size of the print sheet and the selected paper-feed tray, which is supplied to the stencil printing machine 1.

As seen in FIG. 6, the printing-direction display 233 involves a printing-direction icon display 261 for indicating the direction in which the printing is performed, selection boxes 262, 262 for selection of a portrait direction or a landscape direction of the print sheet and a selection box 263 for selection of a capability to enable a picture pattern, to be printed, to be rotated at an angle of 180 degrees.

Upon user's operation to select the selection boxes 262, 263, the CPU is able to recognize whether or not the direction of the print sheet and the image pattern are to be rotated and to produce the printer control commands, indicative of the direction in which the printing is executed, which are supplied to the stencil printing machine 1.

The printing set up display 234 involves a print-number set up column 271 for set up the number of print sheets to be printed, a continuous mode set up column 272 for setting up a function to execute a series of operations from the stencil making process to the printing process, an output method set up column 273 for setting up a function to store (hold) image data in the stencil printing machine 1 and a "HOLD INFORMATION" selection button 274 for setting up various functions when storing image data.

Upon user's operation to set up various contents in the print-number set up column 271, the continuous mode set up column 272, the output method set up column 273 and the "HOLD INFORMATION" selection button 274, the CPU recognizes the function that the stencil printing machine 1 is to be controlled for the preset number of print sheets and in the continuous operating mode as well as other functions with respect to the output method and the stored image data, for thereby producing the printer control commands on the basis of the above information to be supplied to and to control the stencil printing machine 1.

Figure 8:
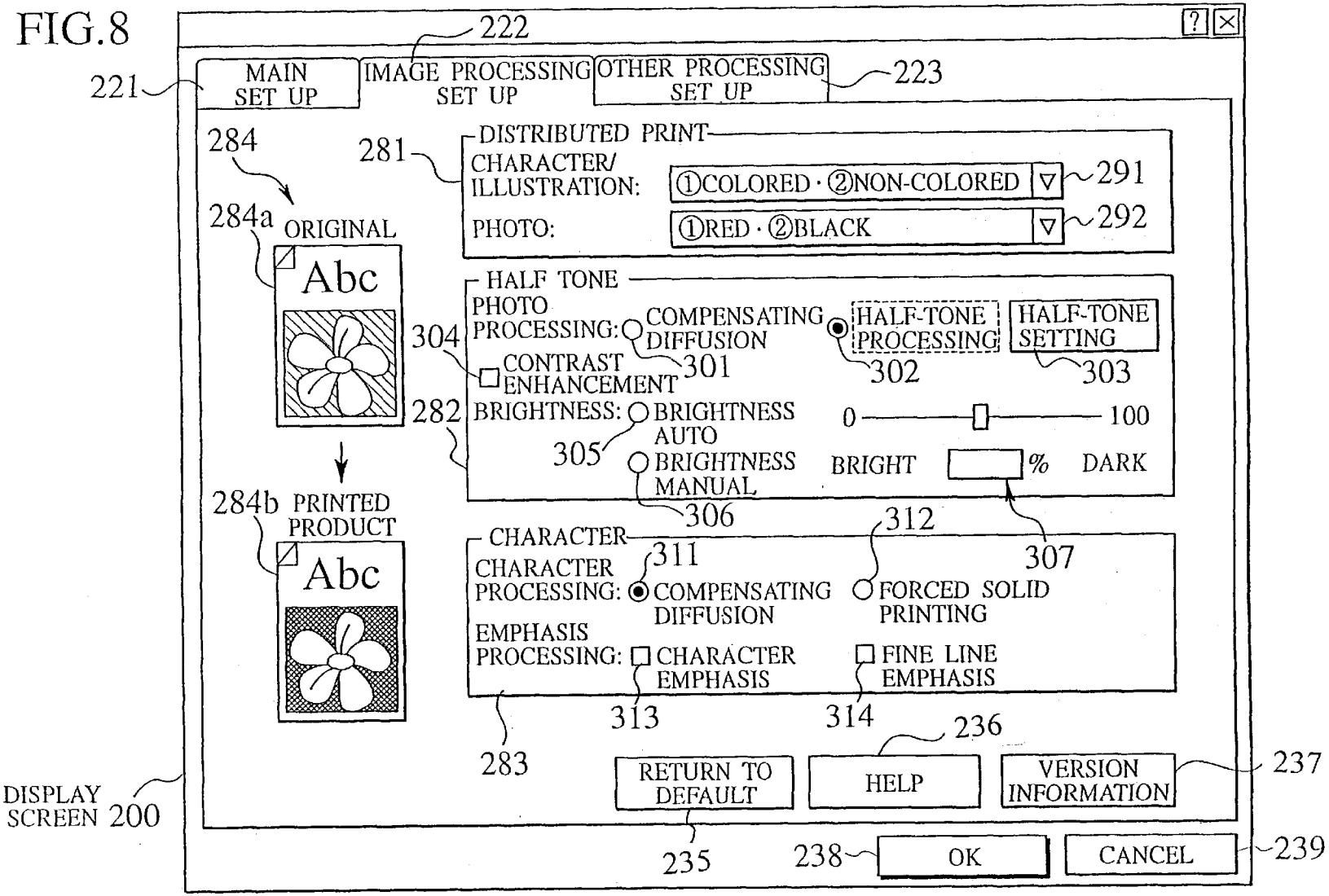
FIG. 8 is a schematic view for illustrating one display content appearing on the display monitor when executing an image set up process with the user PC which is applied with the principal concept of the present invention.

Further still, during execution of the image processing set up operation upon selection of the "IMAGE PROCCESSING SET UP" tab 222, the CPU allows a screen of the "IMAGE PROCCESSING SET UP" tab 222 to appear on the display screen 200 as shown in FIG. 8. The CPU allows a distributed print set up display 281 for executing image processing set up, a half-tone processing set up display 282, a character processing set up display 283 and a sampling display 284.

The distributed print set up display 281 involves an original set up column 291 for character/illustration and a distributed print set up column 292 for a photo. The distributed print set up column 291 enables settings of the printing drum to be used in dependence on a color of the character/illustration, and the distributed print setting column 292 enables settings of the printing drum to be used in dependence on a color of a photo portion of the image pattern.

In an example shown in FIG. 8, the CPU recognizes user's set-up results interactive with the stencil making process using the first printing drum 25 with respect to a colored area of the character/illustration, with the stencil making process using the second printing drum 26 with respect to a non-colored area of the character/illustration, with the stencil making process using the first printing drum 25 with respect to a red area of the photo contained in the image data, and with the stencil making process using the second printing drum 26 with respect to a black area. With such recognition, the CPU functions to execute a simulated (dummy) color printing by setting-up parameters necessary for respective ink colors to be used for the distributed print processing.

Figure 9:
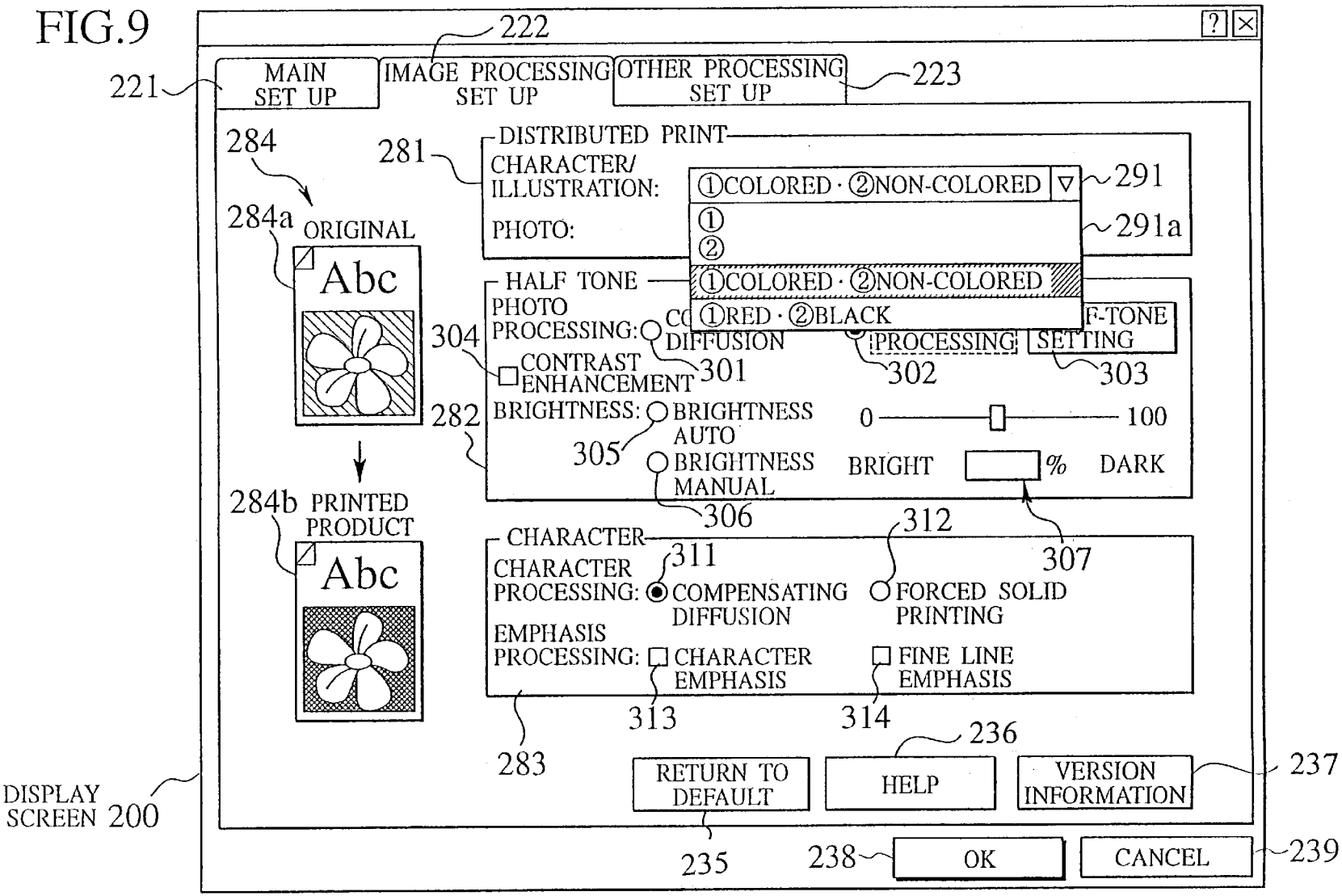
FIG. 9 is a schematic view for illustrating another display content appearing on the display monitor when executing the image set up process with the user PC which is applied with the principal concept of the present invention.

During user's operation to select the contents interactive with the distributed print processing content with respect to the character/illustration, the CPU allows a selection package display 291*a* to appear as shown in FIG. 9 for assisting the user's selection of either the first printing drum 25 or the second printing drum 26 in dependence on a tone of color contained in image data. In this instance, the CPU displays the selection package display 291*a* as shown in FIG. 9, calling the user's attention for selection of the first printing drum 25 and the second printing drum 26 in dependence on the tone of color contained in image data. When either one of the distributed print processing conditions is selected from the selection package display 291*a,* the CPU functions to vary a picture pattern on the sampling display 284 in accordance with the selected distributed print processing condition.

Figure 10:
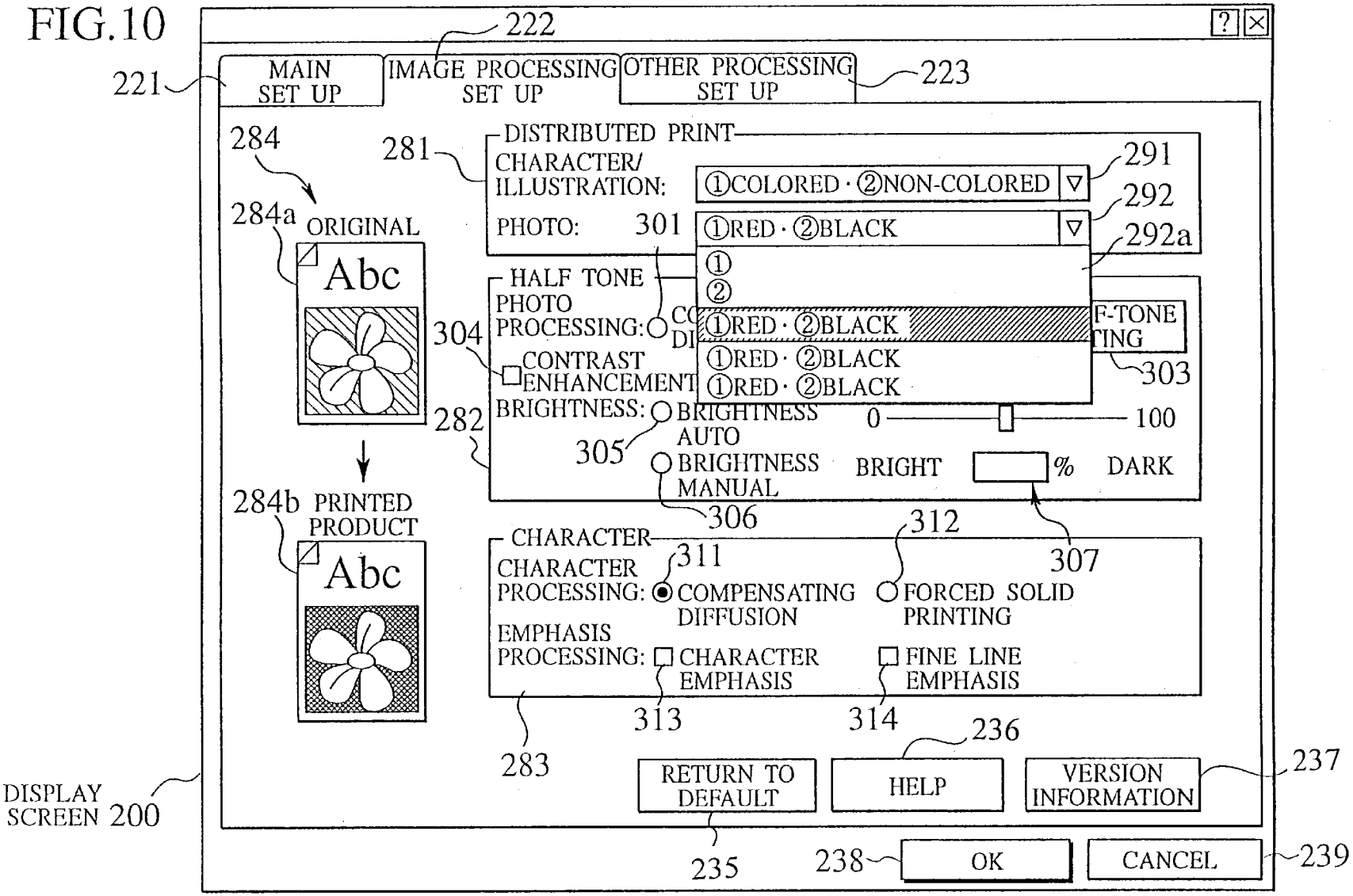
FIG. 10 is a schematic view for illustrating the other display content appearing on the display monitor when executing the image set up process with the user PC which is applied with the principal concept of the present invention.

In addition, during the user's operation to select the distributed print processing condition with respect to the photo, the CPU displays a selection screen for selection of either the first printing drum 25 or the second printing drum 26 in dependence on the tone of color contained in image data. In this instance, the CPU displays a selection package display 292*a* as shown in FIG. 10, calling the user's selection for either the first printing drum 25 or the second printing drum 26 to be used for the distributed print processing operation in dependence on the tone of color contained in image data. When either one of the distributed print processing conditions is selected from the selection package display 292*a,* the CPU functions to vary a picture pattern for the sampling display 284 in accordance with the distributed print processing condition.

In such an example, as viewed in FIG. 9, the CPU recognizes a function to allow the first printing drum 25 to be mounted with a stencil sheet for printing a colored area of the character/illustration portion and a function to allow the second printing drum 26 to be mounted with a stencil sheet for printing a non-colored area of image data. Also, as seen in FIG. 10, the CPU recognizes a function to allow the first printing drum 25 to be mounted with a stencil sheet for printing a red area of the photo portion, and a function to allow the second printing drum 26 to be mounted with a stencil sheet for printing a black area of the photo portion.

The half-tone processing set up display 282 involves a selection box 301 for selecting whether to implement a compensating diffusion to process image data of the photo portion, a selection box 302 for displaying whether to execute a halftone processing, and a halftone processing set up button 303.

Upon user's operation to select the selection boxes 301, 302 and the halftone processing set up button 303 to complete the set up operations correlated with the photo, the CPU executes image processing over the photo portion of image data, to be displayed on the sampling display 284, in dependence on the user's various set-up contents to alter an original sampling display 284*a* and a printed product sampling display 284*b,* thereby giving the user a sampling result of image processing. Upon completion of setting-up for the various contents, the CPU functions to execute the set-up image processing prior to transmitting image data to the stencil printing machine 1.

The halftone processing set up display 282 involves a clear mode selection box 304, a brightness auto-selection box 305, a brightness manual-selection box 306 and a brightness set up column 307.

Upon user's operation to select the clear mode selection box 304, the brightness selection box 305, the brightness manual-selection box 306 and the brightness set up column 307 to complete the required settings related to the photo, the CPU executes image processing over the image data, to be displayed on the sampling display 284, in dependence on the user's various set-up contents to provide the display of the original sampling display 284*a* and the printed product sampling display 284*b,* thereby giving the user a sampling result of image processing. Upon completion of the various content settings, the CPU functions to execute image processing with respect to the brightness to meet the set-up contents prior to transmitting image data to the stencil printing machine 1.

The character processing set up display 283 involves a compensating diffusion selection box 311, a forced solid-print selection box 312 for setting up a forced solid-printing operation, a character emphasis selection box 313 and a fine-line emphasis selection box 314.

The CPU executes the character processing and the emphasis processing over the image data, to be displayed over the sampling display 284, in dependence on the various set-up contents to display the original sampling display 284*a* and the printed product sampling display 284*b,* thereby providing the user a sampling result.

In such a user PC 120, since the printer driver is able to register the ink colors to be used for the first and second printing drums 25 and 26 and to allow particular combinations of the ink colors suited for the respective printing drums to be provided to the user, it is easy to carry out the color management. Accordingly, with the user PC 120, the presence of the cartridge type printing drums held by the user for plural ink colors allows the printer driver to manage the combination of the ink colors to enable exchange of the first printing drum 25 and the second printing drum 26. This results an advantage in the user PC 120 to avoid an erroneous selection of the ink colors while providing an improved workability.

Also, since the user PC 120 enables the display of the sampling display in dependence on the various set-up contents when executing the combining process for the ink colors and the distributed print processing operation, it is possible for the user to have an access to the printed product prior to mounting the cartridge type printing drums to the stencil printing machine 1, there by providing a further improved workability.

Further, the user PC 120 is enabled to transmit data indicative of the set-up ink colors to and receive a response from the stencil printing machine 1, thereby making it possible for the user to be provided with information related to an error in the compared result which is carried out between the combination of the set-up ink colors and the ink color of the cartridge type printing drum mounted to the stencil printing machine 1.

Although, in the illustrated embodiment, furthermore, the present invention has been shown and described with reference to an example of a particular structure wherein the printer driver is installed in the user PC 120 and the stencil printing machine 1 is operated in response to the printer control commands delivered from the printer driver, the printer driver may be stored in a computer readable record medium registered in a language accessible by other computer which may serve as a control unit for the stencil printing machine 1 of the present invention. Consequently, with the use of the program to effectuate the aforementioned process contents stored in a suitable media such as, for example, a disk shaped record medium, aforementioned results may be effectuated by allowing the computer to read in the program of record medium.

In addition, in the examples described above, although the stencil printing machine 1 has been shown and described with reference to a particular structure wherein the first and second printing drums 25 and 26 are employed to perform the two-color printing mode, the stencil printing machine 1 may be of the type having four printing drums. In such an application, the CPU of the user PC 120 may have a printer driver recorded in a memory unit for executing ink-color management related to the four printing drums, thereby achieving the color management for the four ink colors.

What is claimed is:

1. A printing control device for controlling a stencil printing machine, having a plurality of exchangeable printing drums, wherein respective printing drums are mounted with respective perforated stencil sheets which are formed on the basis of image data, and a print sheet is held in press contact with the plural printing drums to perform a stencil printing process, comprising:

a registering section for registering printing ink colors to be used for the printing process using the respective printing drums and storing useable ink color information;

a designating section for producing ink-color designating information to designate a correlated relationship between the useable ink color information indicative of the ink colors registered by the registering section when executing the printing process using the respective printing drums; and a display data producing section for producing display data to display contents of the ink-color designating information produced by the designating section for the respective printing drums.

2. A printing control device according to claim 1, further comprising:

a sampling display data producing section for producing sampling display data to provide a sampling display of a print processing result that would be obtained by using the plural printing drums with the use of particular printing ink colors designated by the ink color designating information produced by the designating section.

3. A printing control device according to claim 1, further comprising:

a control section for producing stencil printing settings information to set up whether to execute the stencil printing process with the respective printing drums to implement a stencil making process for the respective printing drums correlated with ink color information produced by the designating section.

4. A computer-readable record medium having stored thereon a program for controlling a stencil printing machine, having a plurality of exchangeable printing drums, wherein respective printing drums are mounted with respective perforated stencil sheets which are formed on the basis of image data, and a print sheet is held in press contact with the plural printing drums to perform a stencil printing process, comprising:

a registering section for registering printing ink colors to be used for the printing process using the respective printing drums and storing useable ink color information;

a designating section for producing ink-color designating information to designate a correlated relationship between the useable ink color information indicative of the ink colors registered by the registering section when executing the printing process using the respective printing drums; and a display data producing section for producing display data to display contents of the ink-color designating information produced by the designating section for the respective printing drums.

5. A computer-readable record medium according to claim 4, further comprising:

a sampling display data producing section for producing sampling display data to provide a sampling display of a print processing result that would be obtained by using the plural printing drums with the use of particular printing ink colors designated by the ink color designating information produced by the designating section.

6. A computer-readable record medium according to claim 4, further comprising:

a control section for producing stencil printing settings information to set up whether to execute the stencil printing process with the respective printing drums to implement a stencil making process for the respective printing drums correlated with ink color information produced by the designating section.

7. A program product for controlling a stencil printing machine, having a plurality of exchangeable printing drums, wherein respective printing drums are mounted with respective perforated stencil sheets which are formed on the basis of image data, and a print sheet is held in press contact with the plural printing drums to perform a stencil printing process, comprising:

a registering section for registering printing ink colors to be used for the printing process using the respective printing drums and storing useable ink color information;

a designating section for producing ink-color designating information to designate a correlated relationship between the useable ink color information indicative of the ink colors registered by the registering section when executing the printing process using the respective printing drums; and a display data producing section for producing display data to display contents of the ink-color designating information produced by the designating section for the respective printing drums.

8. A program product according to claim 7, further comprising:

a sampling display data producing section for producing sampling display data to provide a sampling display of a print processing result that would be obtained by using the plural printing drums with the use of particular printing ink colors designated by the ink color designating information produced by the designating section.

9. A program product according to claim 7, further comprising:

a control section for producing stencil printing settings information to set up whether to execute the stencil printing process with the respective printing drums to implement a stencil making process for the respective printing drums correlated with ink color information produced by the designating section.

10. A printing system comprising:

a stencil printing machine, including a plurality of exchangeable printing drums, wherein respective printing drums are mounted with respective perforated stencil sheets which are formed on the basis of image data, and a print sheet is held in press contact with the plural printing drums to perform a stencil printing process; and a printing control device including a transmitting section connected to the stencil printing machine for transmitting print data thereto via a communication network, a registering section for registering printing ink colors to be used for printing with the respective printing drums and storing useable ink color information, a designating section for producing ink-color designating information to designate a correlated relationship between the useable ink color information indicative of the ink colors registered by the registering section when executing the printing process using the respective printing drums, and a display data producing section for producing display data to display contents of the ink-color designating information produced by the designating section for the respective printing drums.

11. A printing system according to claim 10, further comprising:

a sampling display data producing section for producing sampling display data to provide a sampling display of a print processing result that would be obtained by using the plural printing drums with the use of particular printing ink colors designated by the ink color designating information produced by the designating section.

12. A printing system according to claim 10, further comprising:

a control section for producing stencil printing setting information to set up whether to execute the stencil printing process with the respective printing drums to implement a stencil making process for the respective printing drums correlated with ink color information produced by the designating section.

* * * * *